US010458240B2

(12) United States Patent
Purcell et al.

(10) Patent No.: US 10,458,240 B2
(45) Date of Patent: Oct. 29, 2019

(54) HYBRID ELASTOMER/METAL ON METAL MOTOR

(71) Applicant: Roper Pump Company, Commerce, GA (US)

(72) Inventors: John Eugene Purcell, Commerce, GA (US); Tyson Bentley Anderson, Watkinsville, GA (US); Edmond Tate Coghlan, Talmo, GA (US)

(73) Assignee: Roper Pump Company, Commerce, GA (US)

( * ) Notice: Subject to any disclaimer, the term of this patent is extended or adjusted under 35 U.S.C. 154(b) by 334 days.

(21) Appl. No.: 15/234,595

(22) Filed: Aug. 11, 2016

(65) Prior Publication Data

US 2016/0348508 A1 Dec. 1, 2016

Related U.S. Application Data

(63) Continuation-in-part of application No. PCT/US2015/015404, filed on Feb. 11, 2015.
(Continued)

(51) Int. Cl.
*E21B 4/02* (2006.01)
*F01C 1/10* (2006.01)
(Continued)

(52) U.S. Cl.
CPC ..... *F01C 21/104* (2013.01); *F01C 19/02* (2013.01); *F01C 21/08* (2013.01); *F03C 2/08* (2013.01);
(Continued)

(58) Field of Classification Search
CPC ..... F01C 1/101; F01C 21/104; F04C 2/1075; F03C 2/08; E21B 4/06; E21B 4/16
(Continued)

(56) References Cited

U.S. PATENT DOCUMENTS 3,652,192 A * 3/1972 Kramer ..... F04C 2/107 418/125
3,975,121 A * 8/1976 Tschirky ..... E21B 4/02 418/48
(Continued)

FOREIGN PATENT DOCUMENTS

DE 10 2008 036511 A1 2/2010
EP 2 256 345 A2 12/2010
(Continued)

OTHER PUBLICATIONS

PCT International Search Report and Written Opinion issued for the International Application No. PCT/US2015/015404, dated Jun. 6, 2016, 19 pages.

*Primary Examiner* — Deming Wan
(74) *Attorney, Agent, or Firm* — Snyder, Clark, Lesch & Chung, LLP

(57) ABSTRACT

A hybrid elastomer/metal on metal motor for a helical gear device includes a rotor and stator comprising a hydraulic motor that produces work when a working fluid is pumped therethrough. The improvement involves the stator being, for part of its length, a conventional or even wall stator, using an elastomer to form a seal against the moving rotor. The stator's remaining length comprises a profiled rigid surface that forms a seal directly with the moving rotor. This gives the motor the high efficiency of the elastomer sealing against the rotor, and simultaneously provides a backup of the stator's rigid section allowing continued motor operation at reduced efficiency, if the elastomer part failed in service. The invention also includes combinations of a regular disk stack with a rubber lining, a rigid material disk stack (or unitized element) and a circular rigid sleeve which react to rotor sideloading while permitting proper rotor orbiting.

22 Claims, 13 Drawing Sheets

Related U.S. Application Data

(60) Provisional application No. 61/938,964, filed on Feb. 12, 2014.

(51) Int. Cl.

| | |
|---|---|
| ***F04C 13/00*** | (2006.01) |
| ***F04C 2/107*** | (2006.01) |
| ***F01C 21/10*** | (2006.01) |
| ***F03C 2/08*** | (2006.01) |
| ***F01C 19/02*** | (2006.01) |
| ***F01C 21/08*** | (2006.01) |

(52) U.S. Cl.
CPC ..... *F04C 2/1075* (2013.01); *F04C 13/008* (2013.01); *F05B 2230/60* (2013.01); *F05B 2240/14* (2013.01); *F05B 2240/30* (2013.01); *F05C 2201/00* (2013.01); *F05C 2225/02* (2013.01)

(58) Field of Classification Search
USPC ..... 29/888.03
See application file for complete search history.

(56) References Cited

U.S. PATENT DOCUMENTS

| | | | | |
|---|---|---|---|---|
| 4,211,521 | A * | 7/1980 | Streicher | F04C 2/1073 418/149 |
| 5,171,139 | A | 12/1992 | Underwood et al. | |
| 5,832,604 | A * | 11/1998 | Johnson | E21B 4/02 29/888.023 |
| 2007/0053783 | A1 | 3/2007 | Jaget et al. | |
| 2009/0016893 | A1* | 1/2009 | Lee | F04C 2/1075 416/241 R |
| 2010/0284843 | A1* | 11/2010 | Jager | F04C 2/1075 418/48 |
| 2014/0170011 | A1* | 6/2014 | Clouzeau | E21B 4/02 418/201.1 |

FOREIGN PATENT DOCUMENTS

| | | | |
|---|---|---|---|
| JP | 2005299494 | A | 10/2005 |
| RU | 2073094 | C1 | 2/1997 |
| WO | 2012024215 | A2 | 2/2012 |
| WO | 2012122321 | A2 | 9/2012 |

* cited by examiner

HYBRID ELASTOMER/METAL ON METAL MOTOR

CROSS-REFERENCE TO RELATED APPLICATIONS

This bypass continuation-in-part application claims priority under 35 U.S.C. § 120 of international patent application PCT/US2015/015404 filed on Feb. 11, 2015 entitled HYBRID ELASTOMER/METAL ON METAL MOTOR, which in turn claims the benefit under 35 U.S.C. § 119(e) of Provisional Application Ser. No. 61/938,964 filed on Feb. 12, 2014 entitled HYBRID ELASTOMER/METAL ON METAL MOTOR and all of whose entire disclosures are incorporated by reference herein.

BACKGROUND OF THE INVENTION

1. Field of Invention

This invention relates generally to motors, and more particularly, to hydraulic motors that produce work when a working fluid is pumped through it.

2. Description of Related Art

Today's downhole drilling motors usually are of the convoluted helical gear expansible chamber construction because of their high power performance and relatively thin profile and because the drilling fluid is pumped through the motor to operate the motor and is used to wash the chips away from the drilling area. These motors are capable of providing direct drive for the drill bit and can be used in directional drilling or deep drilling. In the typical design the working portion of the motor comprises an outer housing having an internal multi-lobed stator mounted therein and a multi-lobed rotor disposed within the stator. Generally, the rotor has one less lobe than the stator to facilitate pumping rotation. The rotor and stator both have helical lobes and their lobes engage to form sealing surfaces which are acted on by the drilling fluid to drive the rotor within the stator. In the case of a helical gear pump, the rotor is turned by an external power source to facilitate pumping of the fluid. In other words, a downhole drilling motor uses pumped fluid to rotate the rotor while the helical gear pump turns the rotor to pump fluid. In prior systems, one or the other of the rotor/stator shape is made of an elastomeric material to maintain a seal there between, as well as to allow the complex shape to be manufactured.

One of the primary problems encountered when using the standard style of stators is that the profile lobes are typically formed entirely of elastomer. See FIG. 1. Since swelling due to thermal expansion or chemical absorption is proportional to the elastomer thickness different parts of the profile expand differently. Moineau, U.S. Pat. No. 1,892,217 and Bourke, U.S. Pat. No. 3,771,906 disclose stators constructed from elastomeric materials of varying section thickness of the elastomer. U.S. Pat. No. 5,832,604 to Johnson et al. discloses a rigid stator made of a disk stack and elastomeric lining. The elastomer allows the stator to begin a run with a tight seal around a rotor from the elastomer or rubber lining, which gives the motor high efficiency.

FIGS. 1-2 depict a prior art metal rotor and a rubber-lined stator having a rubber or elastomeric stator lining and a metal stator tube. This conventional power section stator configuration comprises a profiled rubber section where the rubber has varying thickness. FIGS. 3-4 depict a prior art metal rotor and a metal on metal stator having a metal stator lining and a metal stator tube. Furthermore, FIGS. 5-6 depict another prior art version of a rubber-lined metal stator that utilizes an internally-shaped tube and a profiled rubber section. In this version, referred to as an "even wall power section," the profile of the rubber has an even thickness, as shown most clearly in FIG. 6, as opposed to uneven thickness of the rubber portion in FIG. 2.

However, under difficult conditions of load and temperature, the rubber may not last long enough to finish the planned run. The usual failure mechanism for these conventional power section stators and even wall power section stators is chunking of the rubber as it fatigues due to cyclic loading. The chunking usually commences at the end of the stator where the rotor is connected to the bearing assembly of the motor due to the sideload from the constant velocity joint or flex shaft. Correcting this failure would normally require a time consuming and costly trip out of the well to change the stator. The inventors have contemplated and solved this problem with the realization that a motor with an elastomeric stator could keep operating under such conditions with some modifications that would increase durability and reliability in operation, as will be discussed in greater detail below.

All references cited herein are incorporated herein by reference in their entireties.

BRIEF SUMMARY OF THE INVENTION

This summary is provided to introduce a selection of concepts in a simplified form that are further described below in the detailed description. This summary is not intended to identify essential features of the claimed subject matter, nor is it intended for us in determining the scope of the claimed subject matter.

A stator for a hydraulic motor having an elongated and helically-lobed rotor rotatably disposed therein is disclosed. The stator comprises: a cylindrical stator housing; a first section within the stator housing comprising a generally tubular configuration having elastically deformable elastomeric material defining a first helically convoluted chamber section; and a second section adjacent the first section and fixed within the stator housing, and wherein the second section comprises at least one of: a rigid section (e.g., a plurality of rigid disks stacked together, a unitized member, etc.) comprising a second helically convoluted chamber section matching the first helically convoluted chamber section wherein said first and second helically convoluted chambers are rotationally aligned in a continuous helical relationship to form a helically convoluted chamber for supporting the rotor; and a rigid sleeve defining a cylindrical chamber section for further supporting the rotor.

A method of making a stator for a hydraulic motor adapted to have an elongated and helically-lobed rotor rotatably disposed therein is disclosed. The method comprises: forming a cylindrical stator housing; providing an alignment core tool having at least one of at least one rigid section (e.g., a disk stack, or a unitized member, etc.) positioned thereon and at least one rigid sleeve positioned thereon, wherein the at least one rigid section (e.g., a disk stack or a unitized member, etc.) comprises a helically-convoluted chamber and the at least one rigid sleeve has a cylindrical chamber section; inserting the alignment core tool with the at least one rigid section (a disk stack, or a unitized member, etc.) and the at least one sleeve thereon into the cylindrical stator housing; securing the at least one rigid section (e.g., a disk stack, a unitized element, etc.) and the at least one sleeve to the stator housing; replacing the alignment core tool with an injection core tool, the injection core tool comprising a predetermined stator profile that comprises at least one more lobe than a number of the rotor lobes; injecting an elastomeric material through the stator casing to form a tubular elastomeric section adjacent the at least one of the rigid section (e.g., a disk stack, or a unitized member, etc.) or the at least one rigid sleeve; curing the elastomeric material to form a helically convoluted chamber therein that is aligned with at least one of the helically-convoluted chamber of the at least one rigid section (e.g., a disk stack or at a unitized member, etc.) and of the cylindrical chamber section; and removing the injection core tool.

A method of making a stator for a hydraulic motor adapted to have an elongated and helically-lobed rotor rotatably disposed therein is disclosed. The method comprises: forming a cylindrical stator housing; forming a plurality of disks, each one of the disks having a respective cutout or aperture such that when the plurality of disks are formed into a disk stack, at least one bleed hole path is formed to permit the passage of a material therethrough; providing an alignment core tool having at least one of at least one disk stack positioned thereon, the at least one disk stack comprising a helically-convoluted chamber; inserting the alignment core tool with the at least one disk stack thereon into the cylindrical stator housing; securing the at least one disk stack to the stator housing; replacing the alignment core tool with an injection core tool, the injection core tool comprising a predetermined stator profile that comprises at least one more lobe than a number of the rotor lobes; injecting an elastomeric material through the at least one bleed hole path to form a tubular elastomeric section adjacent the at least one disk stack; curing the elastomeric material to form a helically convoluted chamber therein that is aligned with the helically-convoluted chamber of the at least one disk stack; and removing the injection core tool.

Further scope of applicability of the present invention will become apparent from the detailed description given hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skilled in the art from this detailed description.

BRIEF DESCRIPTION OF SEVERAL VIEWS OF THE DRAWINGS

The invention will be described in conjunction with the following drawings in which like reference numerals designate like elements and wherein:

FIG. 15A depicts a cross-sectional view of the second embodiment, similar to FIG. 11, but using a rigid section only on each end of the stator;

FIG. 15B depicts a cross-sectional view of the second embodiment, similar to FIG. 11, but using a rigid sleeve only on each end of the stator;

FIG. 15C depicts a cross-sectional view of the second embodiment, similar to FIG. 11, but using a rigid section and a rigid sleeve only on one end (e.g., the distal end) of the stator;

DETAILED DESCRIPTION OF THE INVENTION

Figure 1:
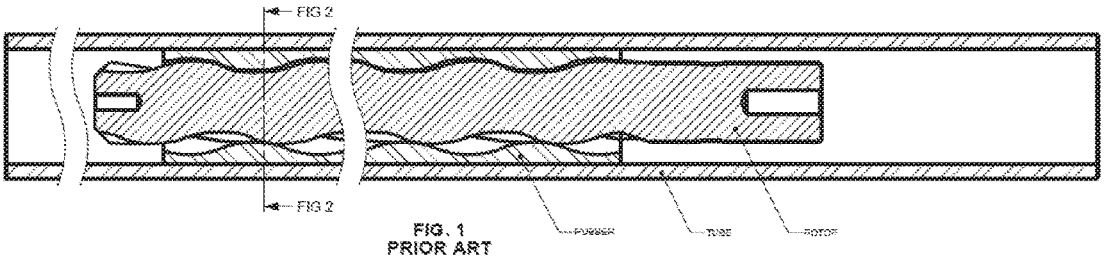
FIG. 1 PRIOR ART
FIG. 1 is a partial, longitudinal cross-sectional view of prior art metal rotor and a rubber lined stator having a rubber or elastomeric stator lining and a metal stator tube.

The present invention will now be described with reference to the accompanying drawings, in which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Like numbers refer to like elements throughout.

Examples of the present invention include a stator for a downhole drilling motor to be used in an oil or gas well, or a utility bore hole. The downhole drilling motor is preferably a hydraulic motor that uses drilling mud flowing through it to create rotary motion that powers a drill bit or other tool. Part of the stator is lined with an elastomer (e.g., rubber, plastic) that fits tightly around a rotor over part of its length. Part of the stator has a profiled rigid section that is shaped like the rubber lined section, but has no rubber. The rigid section part preferably does not fit as tightly around the rotor as the rubber lined part. Part of the stator has a sleeve. The sleeve is sized to allow the rotor to rotate during operation but also to support it. This structure allows the stator to begin a run with a tight seal around the rotor from the rubber lined section, giving the motor high efficiency. Under difficult conditions of load and temperature, the rubber may not last long enough to finish the planned run. This would normally require a time consuming and costly trip out of the well during the run to change the stator. However, a motor with this exemplary stator could continue to operate throughout the run, at reduced efficiency, on the part of the stator that has the profiled metal inside contour plus the profiled metal contour supports the rotor as it orbits thereby reducing the sideload on the rubber section and resulting in longer life of the rubber.

The current invention includes a manufacturing process for making a hybrid stator for pump and motor applications with internally lined sections of elastomer and a rigid material (e.g., metal) having a lobed internal helical profile which preferably contains one more lobe than the rotor. The internally lined elastomer section is a generally tubular section having elastically deformable elastomeric material defining a first helically convoluted chamber section may be made as well known by a skilled artisan, for example, by conventional molding of rubber articles. This section is generally molded or clamped to the stator casing. The rigid section is preferably made from a laminated stack of thin disks bonded to one another to form the desired stator profile. These disks may be manufactured in a variety of ways, with preferred methods including machining via laser, water jet, electrical discharge machining (EDM), milling etc. or a stamping/punching process. They may also be made to shape originally by casting, powder metallurgy or any similar process.

While the various components may be constructed of any material suitable for contact with the human body, the preferred materials of the disks includes metal, for example, steel. The disks may be assembled into a helix by stacking the disks about a mandrel or jig that interacts with lobed features of the disks. The disks may be made in such a way that openings following the helix of the stator for passage of controls, sensors, fluid etc. are created down the length of the stator. The disks may then be bonded to one another to form the disk stack. The disk stack and elastomer section(s) may then be inserted into the stator tube casing, where they are bonded or mechanically fixed to the casing. The rigid or metal section(s) preferably does not fit as tightly around the rotor as the rubber lined section.

The elastomer section (see FIGS. 11-12 and 15A-15H below) may also include a rigid disk stack and an elastomer liner. In this example, the disks in that configuration, when combined, results in the disk stack but not as thick radially as the disk stack formed in the rigid section 30 (again, see FIG. 11). The disks of the elastomer section are smaller in radial width or extension than the disk of the rigid section to allow a generally uniform space for the elastomer lining of the elastomer section, which is typically applied by injection molding.

Figure 2:
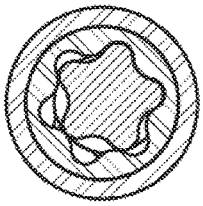
FIG. 2 PRIOR ART
FIG. 2 is a transverse cross-sectional view taken along line 2-2 of FIG. 1.
Figure 3:
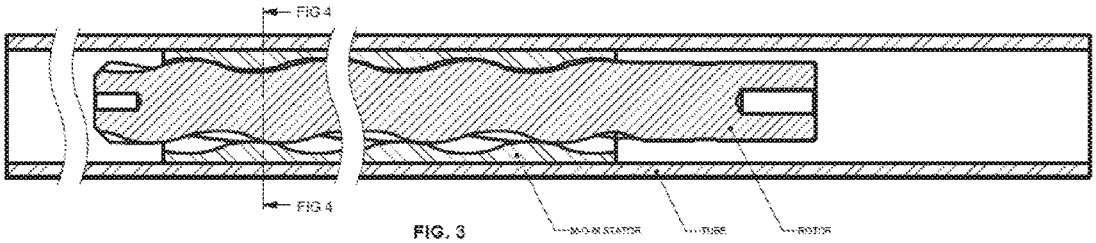
FIG. 3 PRIOR ART
FIG. 3 is a partial, longitudinal cross-sectional view of prior art metal rotor and a metal-on-metal (MOM) stator having a metal stator lining and a metal stator tube.
Figure 4:
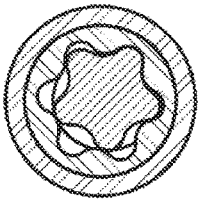
FIG. 4 PRIOR ART
FIG. 4 is a transverse cross-sectional view taken along line 4-4 of FIG. 3.
Figure 5:
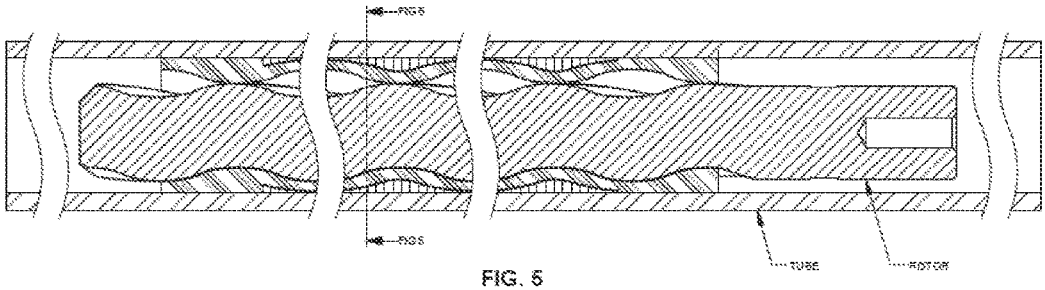
FIG. 5 PRIOR ART
FIG. 5 a partial, longitudinal cross-sectional view of another prior art metal rotor and a rubber lined stator, referred to as an "even wall" power section.
Figure 6:
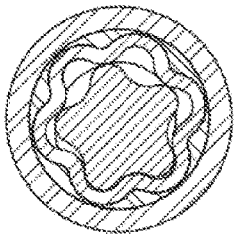
FIG. 6 PRIOR ART
FIG. 6 is a transverse cross-sectional view taken along line 6-6 of FIG. 5.

The present invention also addresses a further deficiency of existing hydraulic motors. A conventional power section when incorporated into a drilling motor is connected to the bearing assembly of the motor using a constant velocity (CV) joint or flex shaft. During operation these connection devices impart a sideload to the rotor that is reacted out by the rubber in the stator. The sideload can be severe enough that it deforms the rubber sufficiently to fatigue it, thereby resulting in short life. For example, as discussed earlier, FIGS. 1-2 depict a prior art metal rotor and a rubber-lined stator having a rubber or elastomeric stator lining and a metal stator tube; FIGS. 3-4 depict a prior art metal rotor and a metal on metal stator having a metal stator lining and a metal stator tube and FIGS. 5-6 depict a prior art combination of these two with a rubber portion of even thickness on the inner surface of the metal stator lining. These prior art devices suffer from, among other things, this sideloading. In contrast, the invention of the present application overcomes the problem by incorporating a rigid (metal or plastic) section 24 (e.g., a plurality of disks 32) to react to the rotor 14 sideload while still allowing the rotor 14 to orbit correctly. Additionally, a circular rigid sleeve 40 is incorporated to also help react the sideload of the rotor while it is orbiting; this rigid sleeve 40 is preferably a metallic material but it may also comprise plastic.

Figure 7:
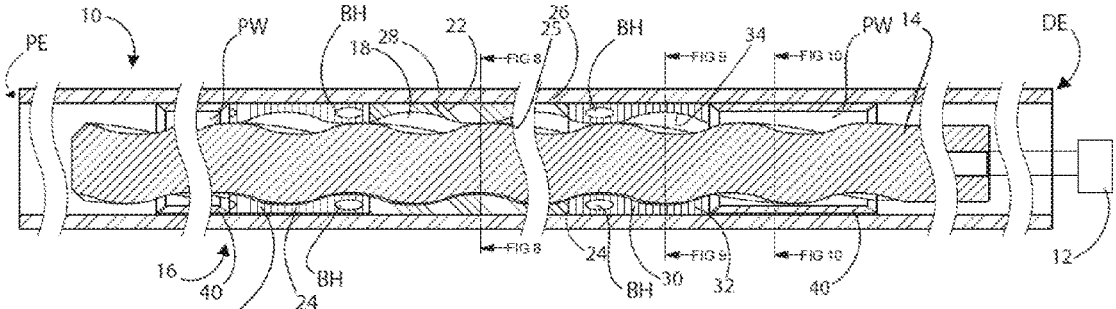
FIG. 7 is a partial, longitudinal cross-sectional view of an exemplary hybrid stator of a first embodiment of the present invention.

FIG. 7 depicts an exemplary first embodiment of a hydraulic motor or pump 10 that has its principal use as a drilling motor for downhole oil well or slurry applications. The motor 10 is shown partially cut away showing a drill bit or similar power device 12 attached (at a distal or working end DE of the stator 16) to an elongated helically lobed rotor 14 extended through a hybrid stator 16. The stator 16 is also a helically lobed structure preferably having at least one more lobe than the rotor, which creates gaps 18 between the rotor 14 and the stator along the longitudinal length therebetween. These gaps 18 progressively move along the length between the rotor 14 and stator 16 as the rotor rotates within the stator, and progressively move fluid in the gaps from one end of the rotor to the other end with the rotation, as is well understood by a skilled artisan.

The stator 16 includes at least one tubular elastomer stator section 22 and at least one rigid stator section 24 housed within a cylindrical outer housing or stator casing 26 and at least one sleeve 40 within the casing 26. By way of example only, FIG. 7 shows all three components present, with a rigid stator station 24 and a sleeve 40 on both sides of the tubular elastomer stator section 22. The stator 16 defines a helically convoluted chamber 20 about the rotor 14. The elastomer stator section 22 includes an elastically deformable liner 28 conventionally made of an elastomeric material. While not being limited to a particular theory, the liner 28 is shown in FIG. 1 as extended between the chamber 20 and the stator casing 26. As can be seen in FIG. 7, the elastically deformable liner 28 is bonded to the stator casing 26, and each rigid stator section 24 is bonded to both the elastically deformable liner and the stator casing. The function of the sleeve 40 is to provide added support of the rotor 14 during operation. The sleeve 40 forms a cylindrical chamber section or passageway PW and is sized so that during operation, the rotor orbit touches the inner diameter of the sleeve 40 and is thereby supported. The rigid sleeve 40 is bonded by for example, welding, fusing, soldering, brazing, sintering, diffusion bonding, mechanical fastening, or via an adhesive bond to the inside surface of the stator casing 26.

Figure 8:
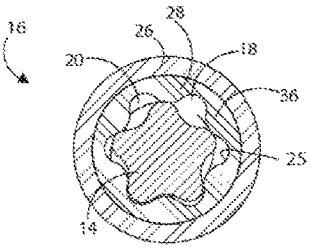
FIG. 8 is a transverse cross sectional view of the hybrid stator along line 8-8 of FIG. 7 showing an elastically deformable liner within a stator casing and housing a rotor therein.
Figure 9:
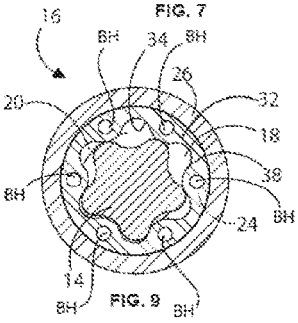
FIG. 9 is a transverse cross-sectional view of the hybrid stator along line 9-9 of FIG. 7 showing a rigid stator section within the stator casing and housing the rotor therein.

FIG. 8 depicts the hybrid stator 16 in traverse cross section, showing the elastically deformable liner 28 defining a first helically convoluted chamber section 25 within the stator casing 26 and housing the rotor 14 therein. FIG. 9 depicts the hybrid stator 16 in traverse cross section, showing the rigid stator section 24 within the stator casing 26 and housing the rotor 14 therein.

The rigid stator section 24 may be a single unit molded into a helical configuration. The single unit is preferably a disk stack 30 having a plurality of like-shaped lobed disks 32. The disks 32 in the disk stack 30 preferably share a common centerline with each disk rotated slightly from the disks on either side to form a helical winding profile as a second helically convoluted chamber section 34 inside the disk stack. The disks 32 may be placed into a helical configuration of the disk stack 30 by stacking the disks onto an alignment assembly that includes an alignment mandrel/core with a profile that catches lobes 38 of the disks with its profile cut in a helical pattern in the alignment core, as readily understood by a skilled artisan. The disks 32 may also be aligned with an alignment assembly including a jig which interacts with disk features other than the inner profile or through features built into the disks (e.g., apertures through the disk lobes) that rotate each disk slightly relative to neighboring disks.

In some cases it is then necessary to tighten the alignment of the disk stack 30 by the application of force to the outer diameter of the stack by, for example, swaging, v-blocking or hammering in either a static or rotating condition. The disk stack 30 is set by fixing the rigid disks 32 together with a bond provided by, for example, welding, fusing, soldering, brazing, sintering, diffusion bonding, mechanical fastening, or via an adhesive bond. The stator casing 26, which preferably is made of metal, may be straightened, chamfered, machined, cleaned and heated as required and understood by a skilled artisan. The stator casing is another bonding member that may then be slid over the disk stack and bonded together (e.g., welding, fusing, soldering, brazing, sintering, diffusion bonding, mechanical fastening, adhesive) to further fix the rigid disk together. The alignment assembly may then be removed from the disk stack 30. It should be noted that depending on the disk stack alignment methodology, it may be required or preferred to insert the disk stack 30 into the stator casing 26 without the alignment tooling entering the outer housing as well.

As can best be seen in FIG. 9, each disk 32 includes a convoluted cavity 34 with the exemplary disk having a number of equally spaced symmetrical lobes 38 radially extending toward the centerline. Preferably all of the disks have substantially identical construction and dimension. In the exemplary embodiments the disk stack 30 provides the final profile geometry of the stator 16 along the rigid stator section 24.

Figure 10:
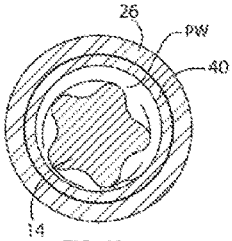
FIG. 10 is a transverse cross-sectional view of the hybrid stator along taken along line 10-10 of FIG. 7 and showing a sleeve within the stator casing and housing a rotor therein.

FIG. 10 depicts, among other things, a cross-section of the rigid sleeve 40 which may comprise a metallic material.

Figure 11:
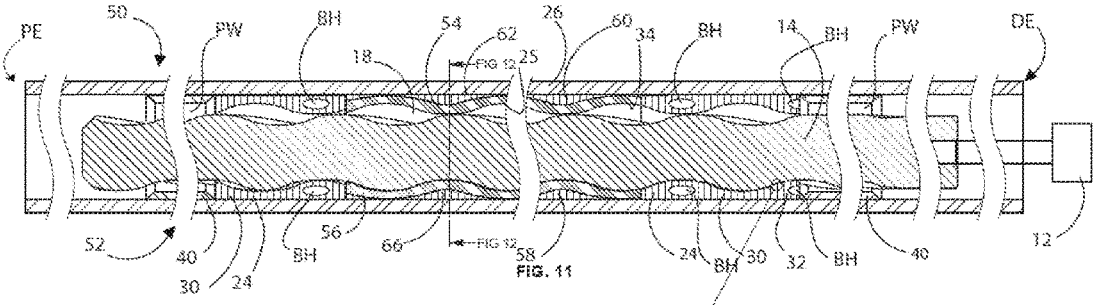
FIG. 11 is a partial, longitudinal cross-sectional view of a second embodiment of an exemplary hybrid stator of the present invention.
Figure 12:
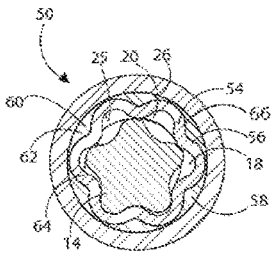
FIG. 12 is a transverse cross-sectional view of the hybrid stator along line 12-12 of FIG. 11 showing an elastically deformable liner and rigid disk stack within the stator casing and housing the rotor therein.

FIGS. 11 and 12 depict a second exemplary embodiment of a hydraulic motor or pump 50 similar to the motor 10 discussed above. The motor 50 also includes a hybrid stator 52 similar to the hybrid stator 16. By way of example only, FIGS. 11-12 show all three components present, namely, the hybrid stator 52 includes at least one tubular elastomer stator section 54 and at least one rigid stator section 24 housed within a cylindrical outer housing or stator casing 26 and the sleeve 40. However, in this embodiment, the elastomer section 54 includes an elastically deformable liner 56 conventionally made of an elastomeric material and defines the first helically convoluted chamber section 25 about the rotor 14. The elastomer section 54 also includes a supportive section 58 that is bonded to the elastically deformable liner 56 and the stator casing, and is preferably rigid to provide greater support to the hybrid stator 52 against the rotating rotor 14. Subsequent reference in the Specification and Figures to the elastomer section 54 implies the inclusion of the deformable liner 56 and supportive section 58. As can be seen in FIG. 11, the elastically deformable liner 56 and the supportive section 58 are also bonded to each adjacent rigid stator section 24. The rigid sleeve 40 is similar to the sleeve discussed previously in the first embodiment. As with the first embodiment, it should be understood that it is within the broadest scope of the present invention to have the hybrid stator 52 include at least one tubular elastomer section 54 and at least either the one rigid stator section 24 or the one rigid sleeve 40.

While not being limited to a particular theory, the supportive section 58 is molded into a helical configuration. Similar to the rigid stator section 24, the supportive section 58 may include a disk stack 60 similar to the disk stack 30 as having a plurality of like-shaped lobed disks 62. The disks 62 in the disk stack 60 share a common centerline with each disk rotated slightly from the disks on either side to form a helical winding profile inside the disk stack. As can best be seen in FIG. 12, each disk 62 defines a convoluted cavity 64 larger than the convoluted cavity 34 defined by the disks 32. This results in a disk stack 60 with a helically convoluted chamber section 66 preferably broader than the second helically convoluted chamber section 34. The elastically deformable liner 56 is bonded to the disk stack 60 to form the first helically convoluted chamber section 25.

Figure 13:
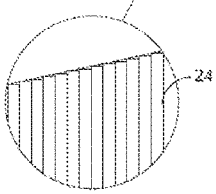
FIG. 13 is an enlarged view of the disk stack of FIG. 11 showing a saw tooth surface that prevents galling between the rotor and disk stack surfaces during rotor rotation.

FIG. 13 depicts an enlarged view of the inner surface of the disk stack 30 of the rigid stator section 24. As can be seen, the inner surface forms a "saw-tooth surface" that creates a "tortuous path" for fluid flow (also referred to as a "labyrinth seal") between the rotor 14 and disk stack 30 confronting surfaces. This configuration also prevents galling (a form of wear based on adhesion of sliding surfaces) that would normally occur between the rotor 14 and disk stack 30 surfaces. It should be further understood that this saw-tooth surface configuration is applicable to the disk stack 30 surfaces used in the first embodiment (FIGS. 7-10, 14A-14H) and the second embodiment (FIGS. 11-13, 15A-15H) that supports a labyrinth seal for that embodiment also.

Although FIGS. 7 and 11 depict the sequence of the rigid sleeve (RS) 40, the rigid section 30 and the tubular elastomer (TE) 22/54 as one moves inward either from the proximal PE or distal end DE of the hybrid stator 16, it should be understood that it is within the broadest scope of the present invention to include various combinations and/or arrangements of these three components within the stator casing 26. As a result, the following configurations of the hybrid stator 16/52 are covered by the present invention.

Section Combinations in the First Embodiment

Figure 14A:
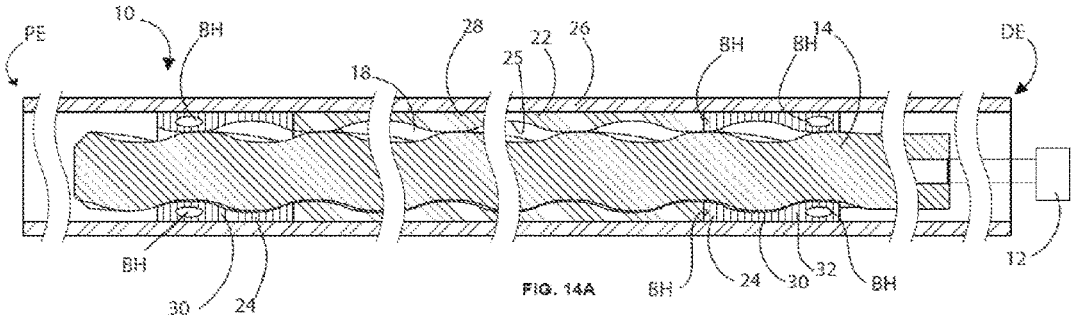
FIG. 14A depicts a cross-sectional view of the first embodiment, similar to FIG. 7, but using a rigid section only on each end of the stator.
Figure 14B:
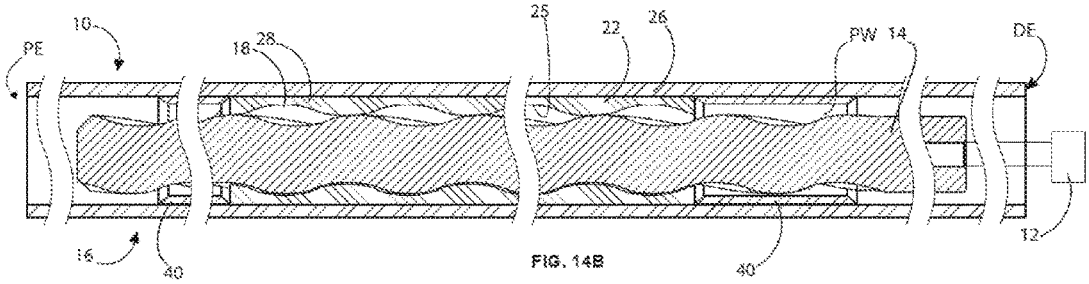
FIG. 14B depicts a cross-sectional view of the first embodiment, similar to FIG. 7, but using a rigid sleeve only on each end of the stator.
Figure 14C:
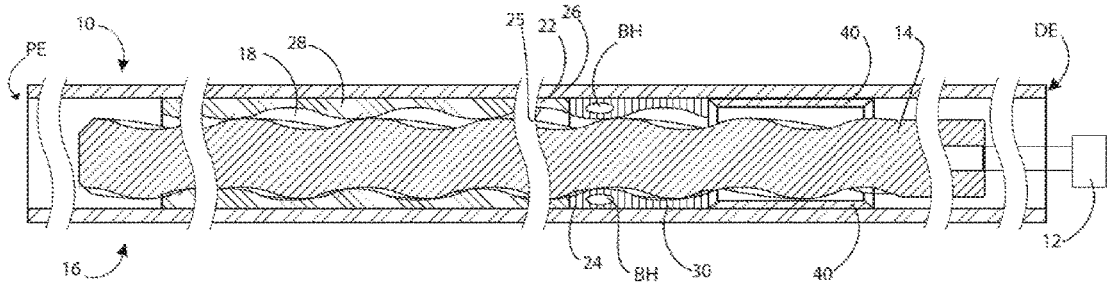
FIG. 14C depicts a cross-sectional view of the first embodiment, similar to FIG. 7, but using a rigid section and a rigid sleeve only on one end (e.g., the distal end) of the stator.
Figure 14D:
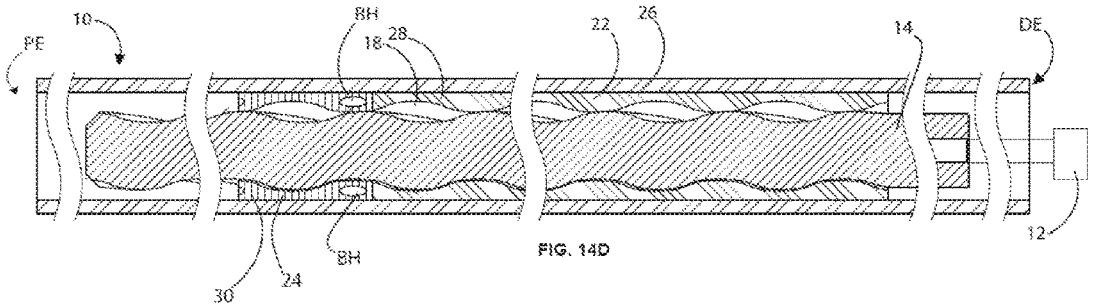
FIG. 14D depicts a cross-sectional view of the first embodiment, similar to FIG. 7, but using a rigid section only on one end (e.g., the proximal end) of the stator.
Figure 14E:
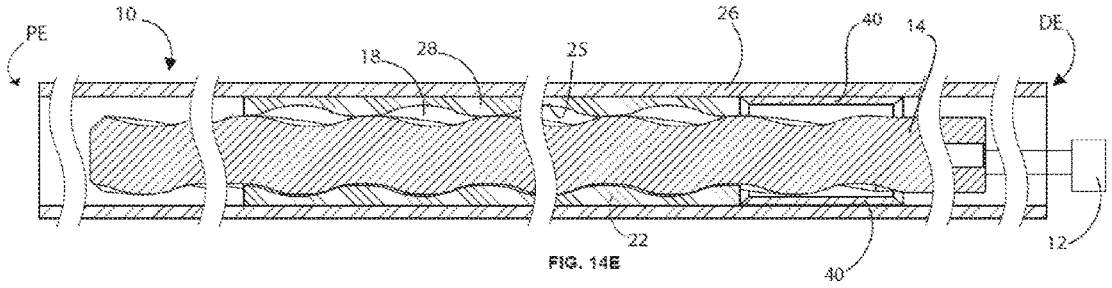
FIG. 14E depicts a cross-sectional view of the first embodiment, similar to FIG. 7, but using a rigid sleeve only on one end (e.g., the distal end) of the stator.
Figure 14F:
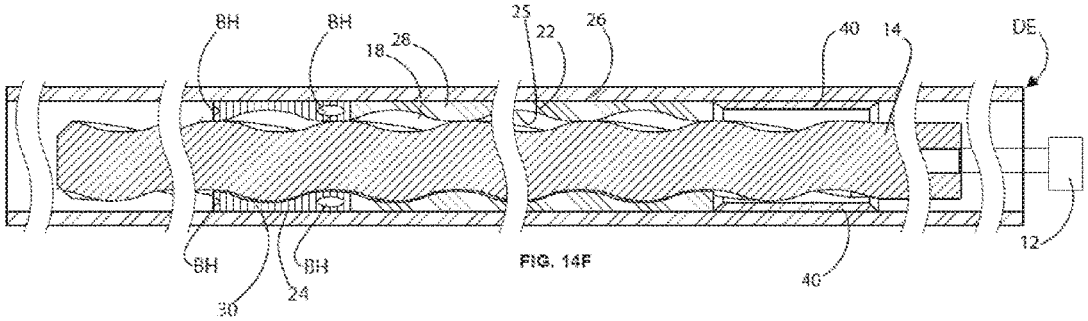
FIG. 14F depicts cross-sectional view of the first embodiment, similar to FIG. 7, but using a rigid section on one end (e.g., the proximal end) and a rigid sleeve only on the other end (e.g., the distal end) of the stator.
Figure 14G:
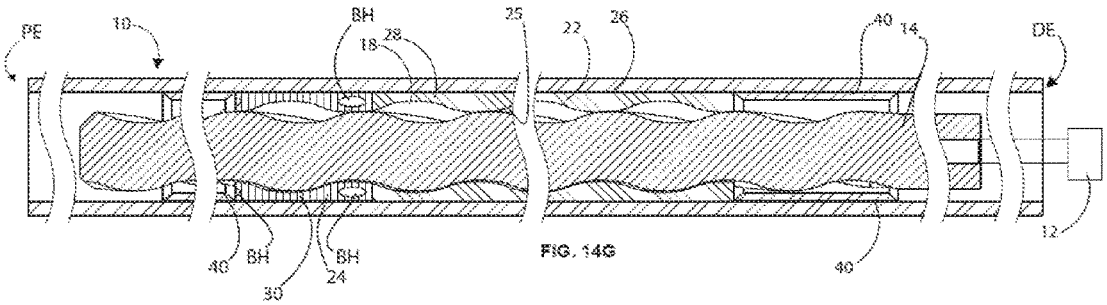
FIG. 14G depicts cross-sectional view of the first embodiment, similar to FIG. 7, but using a rigid sleeve and a rigid section on one end (e.g., the proximal end) and only a rigid sleeve on the other end (e.g., the distal end) of the stator.
Figure 14H:
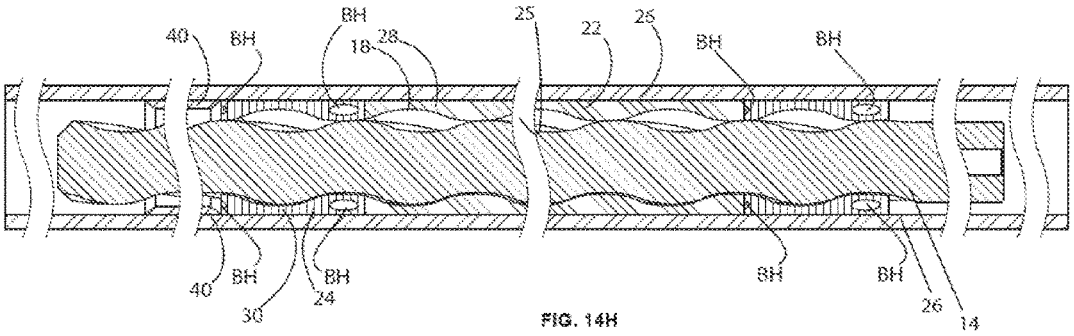
FIG. 14H depicts cross-sectional view of the first embodiment, similar to FIG. 7, but using a rigid sleeve and a rigid section on one end (e.g., the proximal end) and a rigid section only on the other end (e.g., the distal end) of the stator.

In addition to the arrangement of the different sections shown in FIG. 7, the following combinations are within the broadest scope of the present invention:

FIG. 14A depicts a cross-sectional view of the first embodiment but using a rigid section only on each end of the stator; or FIG. 14B depicts a cross-sectional view of the first embodiment but using a rigid sleeve only on each end of the stator; or FIG. 14C depicts a cross-sectional view of the first embodiment but using a rigid section and a rigid sleeve only on one end (e.g., only on the distal end or only on the proximal end) of the stator; or FIG. 14D depicts a cross-sectional view of the first embodiment but using a rigid section only on one end (e.g., only on the proximal end or only on the distal end) of the stator; or FIG. 14E depicts a cross-sectional view of the first embodiment but using a rigid sleeve only on one end (e.g., only on the distal end or only on the proximal end) of the stator; or FIG. 14F depicts cross-sectional view of the first embodiment but using a rigid section on one end (e.g., the proximal end) and a rigid sleeve only on the other end (e.g., the distal end) of the stator, or reversing these end locations; or FIG. 14G depicts cross-sectional view of the first embodiment but using a rigid sleeve and a rigid section on one end (e.g., the proximal end) and a rigid sleeve only on the other end (e.g., the distal end) of the stator, or reversing these end locations; or FIG. 14H depicts cross-sectional view of the first embodiment but using a rigid sleeve and a rigid section on one end (e.g., the proximal end) and a rigid section only on the other end (e.g., the distal end) of the stator, or reversing these end locations.

Section Combinations in the Second Embodiment

Figure 15D:
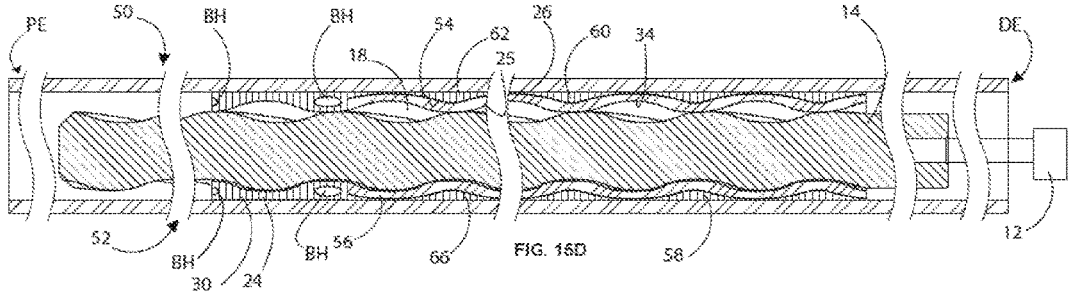
FIG. 15D depicts a cross-sectional view of the second embodiment, similar to FIG. 11, but using a rigid section only on one end (e.g., the proximal end) of the stator.
Figure 15E:
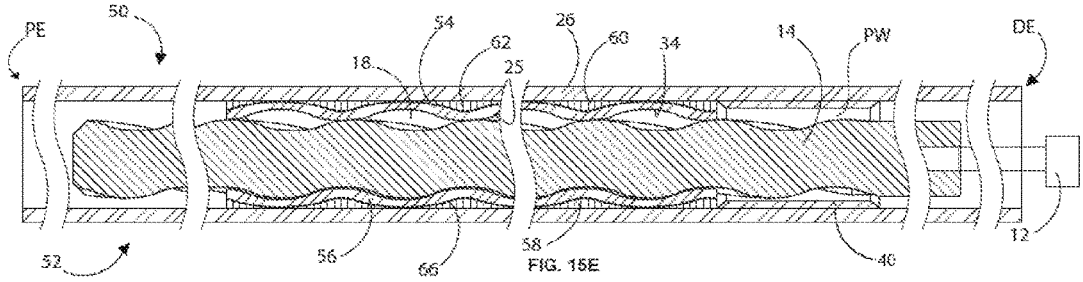
FIG. 15E depicts a cross-sectional view of the second embodiment, similar to FIG. 11, but using a rigid sleeve only on one end (e.g., the distal end) of the stator.
Figure 15F:
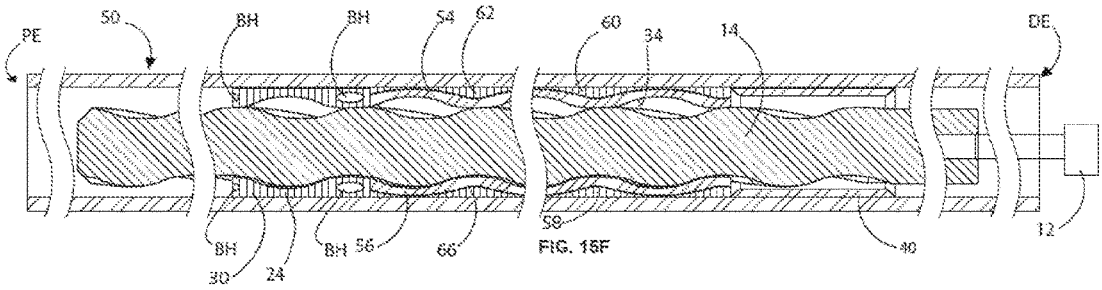
FIG. 15F depicts cross-sectional view of the second embodiment, similar to FIG. 11, but using a rigid section on one end (e.g., the proximal end) and a rigid sleeve only on the other end (e.g., the distal end) of the stator.
Figure 15G:
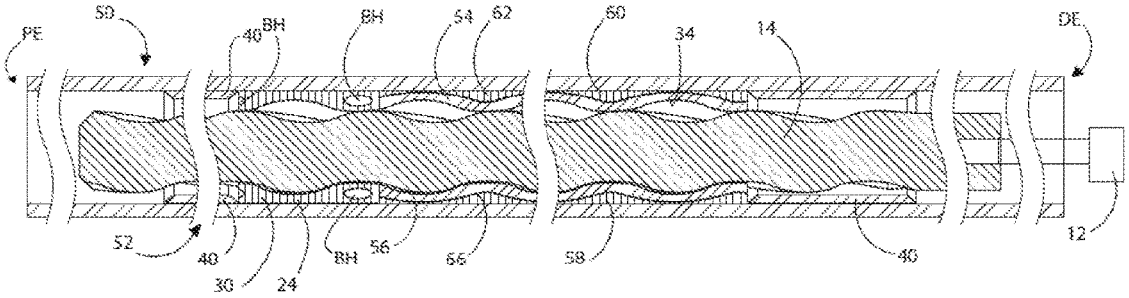
FIG. 15G depicts cross-sectional view of the second embodiment, similar to FIG. 11, but using a rigid sleeve and a rigid section on one end (e.g., the proximal end) and a rigid sleeve only on the other end (e.g., the distal end) of the stator.
Figure 15H:
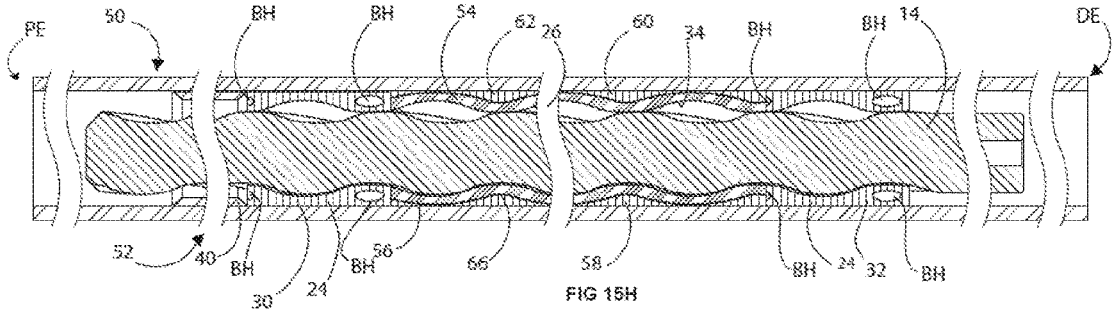
FIG. 15H depicts cross-sectional view of the second embodiment, similar to FIG. 11, but using a rigid sleeve and a rigid section on one end (e.g., the proximal end) and a rigid section only on the other end (e.g., the distal end) of the stator.
Figure 16A:
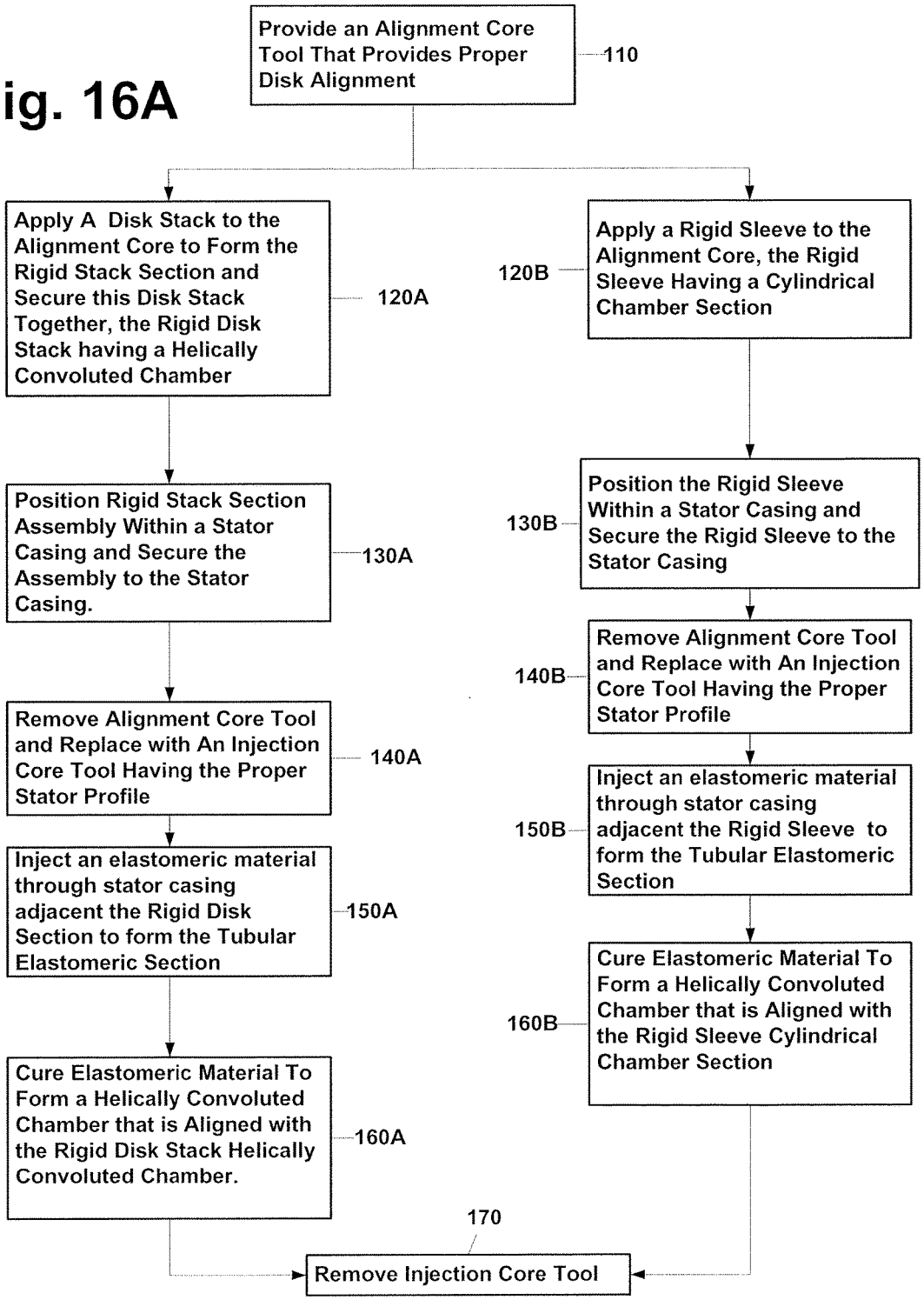
Figure 16B:
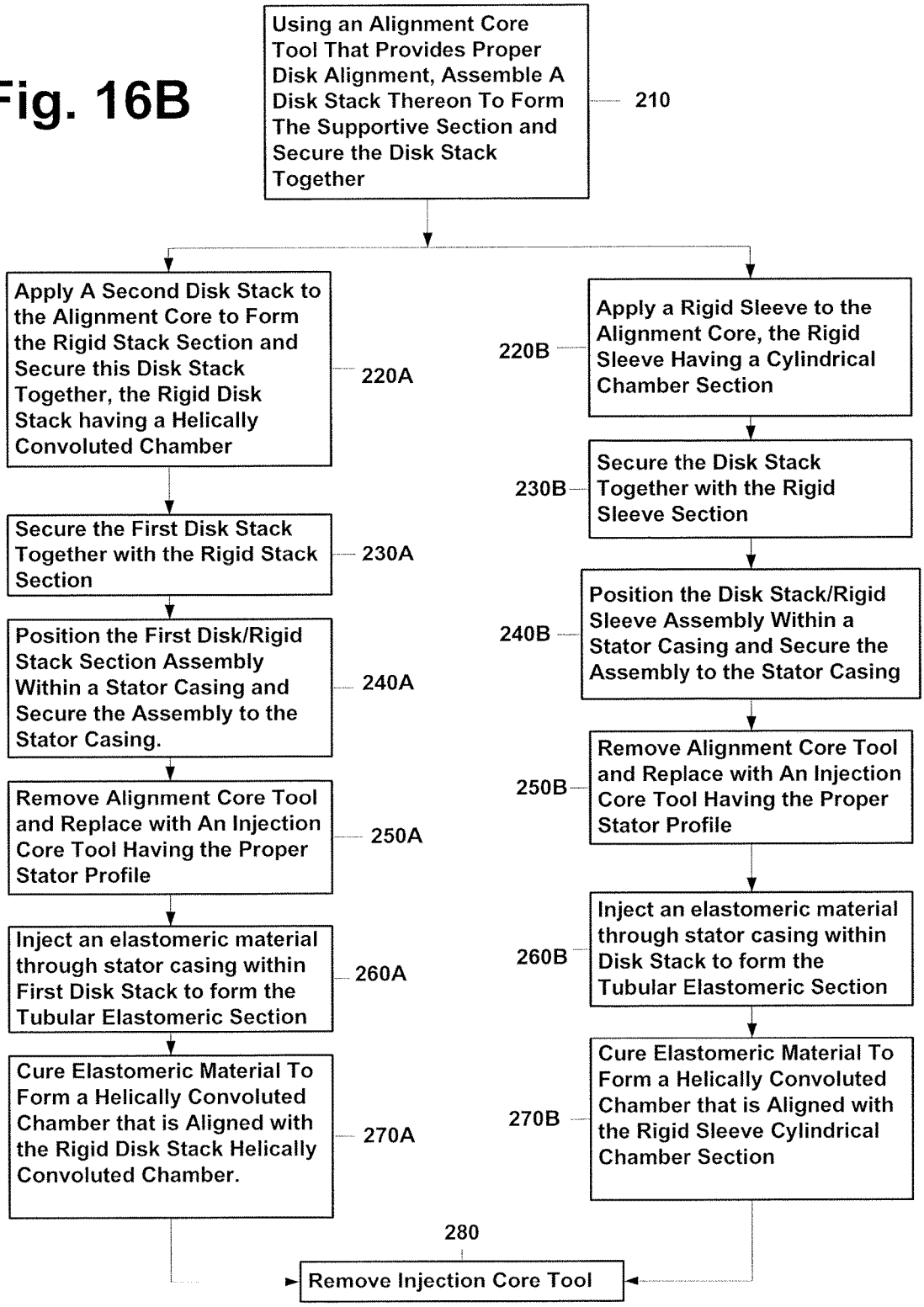

In addition to the arrangement of the different sections shown in FIG. 11, the following combinations are within the broadest scope of the present invention:

FIG. 15A depicts a cross-sectional view of the second embodiment but using a rigid section only on each end of the stator; or FIG. 15B depicts a cross-sectional view of the second embodiment but using a rigid sleeve only on each end of the stator; or FIG. 15C depicts a cross-sectional view of the second embodiment but using a rigid section and a rigid sleeve only on one end (e.g., only on the distal end or only on the proximal end) of the stator; or FIG. 15D depicts a cross-sectional view of the second embodiment but using a rigid section only on one end (e.g., only on the proximal end or only on the distal end) of the stator; or FIG. 15E depicts a cross-sectional view of the second embodiment but using a rigid sleeve only on one end (e.g., only on the distal end or only on the proximal end) of the stator; or FIG. 15F depicts cross-sectional view of the second embodiment but using a rigid section on one end (e.g., the proximal end) and a rigid sleeve only on the other end (e.g., the distal end) of the stator, or reversing these end locations; or FIG. 15G depicts cross-sectional view of the second embodiment but using a rigid sleeve and a rigid section on one end (e.g., the proximal end) and a rigid sleeve only on the other end (e.g., the distal end) of the stator, or reversing these end locations; or FIG. 15H depicts cross-sectional view of the second embodiment but using a rigid sleeve and a rigid section on one end (e.g., the proximal end) and a rigid section only on the other end (e.g., the distal end) of the stator, or reversing these end locations.

Figure 16A:
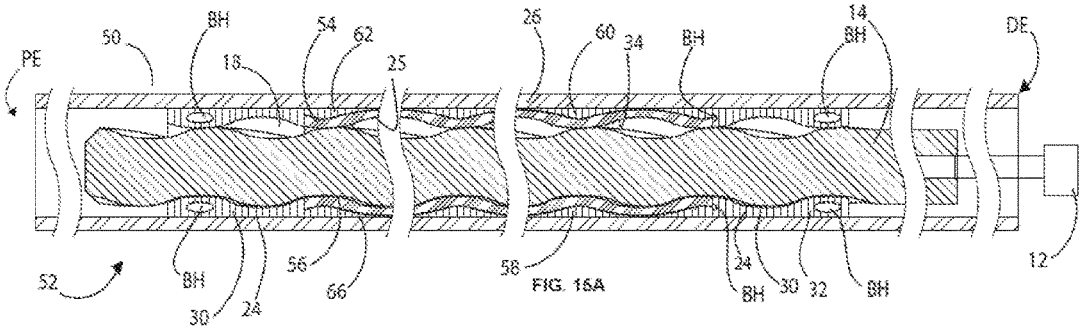
FIG. 16A is a flow diagram illustrating an exemplary method for producing an exemplary hybrid stator in accordance with the broadest configurations of the first embodiment as shown in FIGS. 13A and 13B.
Figure 16B:
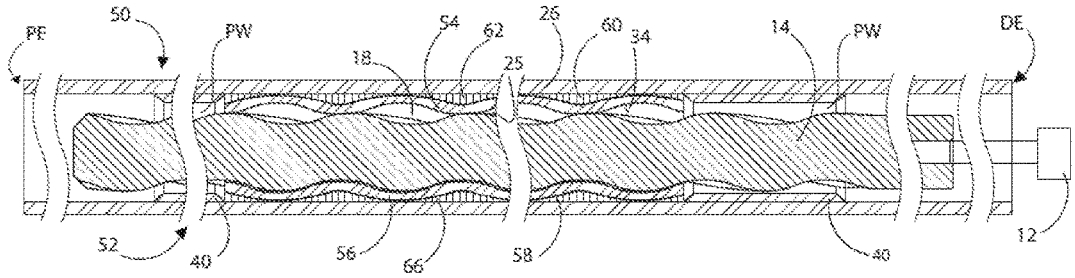
FIG. 16B is a flow diagram illustrating an exemplary method for producing an exemplary hybrid stator in accordance with the broadest configurations of the second embodiment as shown in FIGS. 13A and 13B.
Figure 16C:
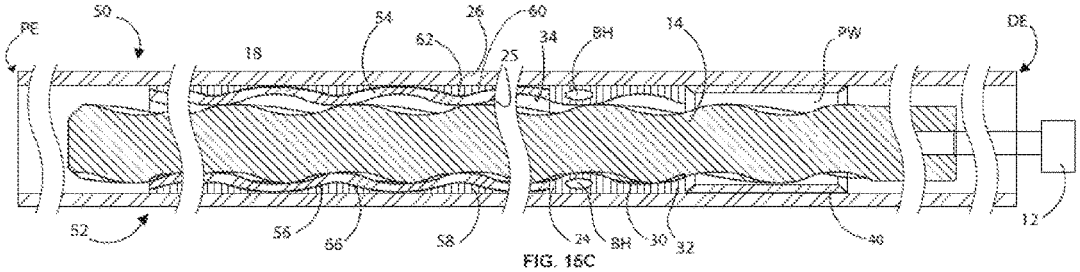

FIG. 16A provides a flow diagram of an exemplary method for forming one of the broadest configurations (FIGS. 14D and 14E) of the first embodiment. In particular, the steps 110-170 depicted on the left hand side of FIG. 16A set forth the method of forming the first embodiment with at least one rigid disk stack 24 whereas the steps 110-170 depicted on the right hand side of FIG. 16A set forth the method of forming the first embodiment using at least one rigid sleeve 40. FIG. 16B provides a flow diagram of an exemplary method for forming one of the broadest configurations (FIGS. 15D and 15E) of the second embodiment. In particular, the steps 210-280 depicted on the left hand side of FIG. 16B set forth the method of forming the second embodiment with at least one rigid disk stack 24 whereas the steps 210-280 depicted on the right hand side of FIG. 16B set forth the method of forming the second embodiment using at least one rigid sleeve 40. It should be noted that the bleed holes BH depicted in FIGS. 7 and 11 provide an alternative method for forming the tubular elastomer sections 22 and 54 respectively and that alternative method is discussed with regard to FIGS. 17A-17B.

As shown in FIG. 16A, at step 110 an alignment core (not shown), which provides proper disk alignment (e.g., a tool having a circular helix shaped alignment) where a rigid disk stack 30 is used. At step 120A Individual disks are placed on the alignment core to form the rigid stack section 30 at the proper location along the alignment core and then this disk stack 30 is secured together (e.g., an outer weld, etc.) thereby forming a helically convoluted chamber through the disk stack 30. This disk stack 30 comprises a plurality of rigid disks in aligned face-to-face stacked relationship with one another, with each disk rotated with respect to the next adjacent disks progressively along the length of the aligned disks in one direction of rotation to define a helically convoluted chamber section. The disks may be placed in compression with compression springs to keep the disk stack tight. Then, the disk stack may be bonded together, for example, by running weld beads down the length of the disk stack or by brazing the stack together. At step 130A, the alignment core tool with the disk stack is positioned inside the stator casing 26 at the proper location and the disk stack 30 is secured to the stator casing 26. At step 140A, the alignment core tool is removed and replaced with an injection core tool (not shown) wherein the injection core tool has a proper stator profile. The phrase "proper stator profile" means that the tool forms a stator volume that includes one more lobe than the number of rotor lobes in order to permit proper rotation of the rotor 14 within the stator 16, as discussed earlier. At step 150A, the elastomeric material is injected through the stator casing 26 adjacent the disk stack 30 to form the tubular elastomeric section 22. At step 160A, the elastomeric material is cured to form its own helically convoluted chamber that is aligned with the helically convoluted chamber in the disk stack 30. The disk stack 30 and tubular elastomeric section 22 are secured together and at step 170 the injector core tool is removed. Alternatively, instead of inserting a rigid disk section 30, the operator can insert a rigid sleeve 40 in accordance with steps 120B-160B. In particular, at step 120B, a rigid sleeve 40 is applied to the alignment core at the proper position along the alignment core. At step 130B, the alignment core with the rigid sleeve 40 is positioned inside the stator casing 26 at the proper location and it is secured to the stator casing 26. At step 140B, the alignment core tool is removed and replaced with the injection core tool described previously. At step 150B, the elastomeric material is injected through the stator casing 26 adjacent the rigid sleeve 40 to form the tubular elastomeric section 22. At step 160B, the elastomeric material is cured to form its own helically convoluted chamber that is aligned with a cylindrical chamber in the rigid sleeve 40. The rigid sleeve 40 and tubular elastomeric section 22 are secured together and at step 170 the injector core tool is removed.

It should be understood that to form the embodiments shown in FIGS. 14A-14C, 14F-14H and that shown in FIG. 7, the additional stator components (e.g., the second rigid disk stack 30, the second sleeve 40, and/or the sequence of the rigid disk stack 30 followed by the rigid sleeve 40, etc.) can be placed on the alignment core tool at the proper position when the alignment core tool is inserted into the stator casing 26. Another alternative to placing all of these components on the alignment core tool first, is to place the appropriate components on the alignment core tool, insert them in one end of the stator casing 26, form the tubular elastomeric section as described and then insert the alignment core tool with the appropriate stator components (e.g., the second rigid disk stack 30, the second sleeve 40, and/or the sequence of the rigid disk stack 30 followed by the rigid sleeve 40, etc.) through the other end of the stator casing 26 and secure those to the stator casing 26 and to each other.

As shown in FIG. 16B, steps for forming the broadest configurations (FIGS. 15D and 15E) using the second embodiment is shown. At step 210, a first disk stack is assembled and secured together at its proper location on the alignment core to form the supportive section 58. If the rigid disk stack 30 is to be used, then at step 220A the rigid disk stack 30 is assembled and secured together on the alignment tool. At step 230A, the first disk stack and the rigid disk stack 30 are secured together. At step 240A, the alignment tool with the two disk stacks is positioned within the stator casing 26 at the proper location and the disk stacks are secured to the stator casing 26. At step 250A, the alignment core tool is removed and replaced with the injection core tool having the proper stator profile, as discussed previously. At step 260A, the elastomeric material is injected through the stator casing 26 to form the tubular elastomeric section 54 against within the supportive section 58. At step 270A, the elastomeric material is cured to form a helically convoluted chamber that matches the helically convoluted chamber in the disk stack 30. In addition, the elastomeric material and the supportive sleeve 58 are bonded, most likely via heat and/or adhesive. At step 280, the injection core tool is removed. Alternatively, instead of inserting a rigid disk section 30, the operator can insert a rigid sleeve 40 in accordance with steps 220B-270B. In particular, at step 220B, a rigid sleeve 40 is applied to the alignment core at the proper position along the alignment core adjacent the first disk stack. At step 230B, first disk stack and the rigid sleeve are secured together. At step 240B, the alignment core with the first disk stack and rigid sleeve 40 is positioned inside the stator casing 26 at the proper location and they are secured to the stator casing 26. At step 250B, the alignment core tool is removed and replaced with the injection core tool described previously. At step 260B, the elastomeric material is injected through the stator casing 26 adjacent the rigid sleeve 40 to form the tubular elastomeric section 54. At step 270B, the elastomeric material is cured having a helically convoluted chamber that is aligned with a cylindrical chamber section of the rigid sleeve 40. As mentioned with regard to step 270A, the elastomeric material and the supportive section 58 are bonded, most likely via heat and/or adhesive.

As mentioned earlier, it should be understood that to form the embodiments shown in FIGS. 15A-15C, 15F-15H and that shown in FIG. 11, the additional stator components (e.g., the second rigid disk stack 30, the second sleeve 40, and/or the sequence of the rigid disk stack 30 followed by the rigid sleeve 40, etc.) can be placed on the alignment core tool at the proper position when the alignment core tool is inserted into the stator casing 26. Another alternative to placing all of these components on the alignment core tool first, is to place the appropriate components on the alignment core tool, insert them in one end of the stator casing 26, form the tubular elastomeric section as described and then insert the alignment core tool with the appropriate stator components (e.g., the second rigid disk stack 30, the second sleeve 40, and/or the sequence of the rigid disk stack 30 followed by the rigid sleeve 40, etc.) through the other end of the stator casing 26 and secure those to the stator casing 26 and to each other.

Figure 17A:
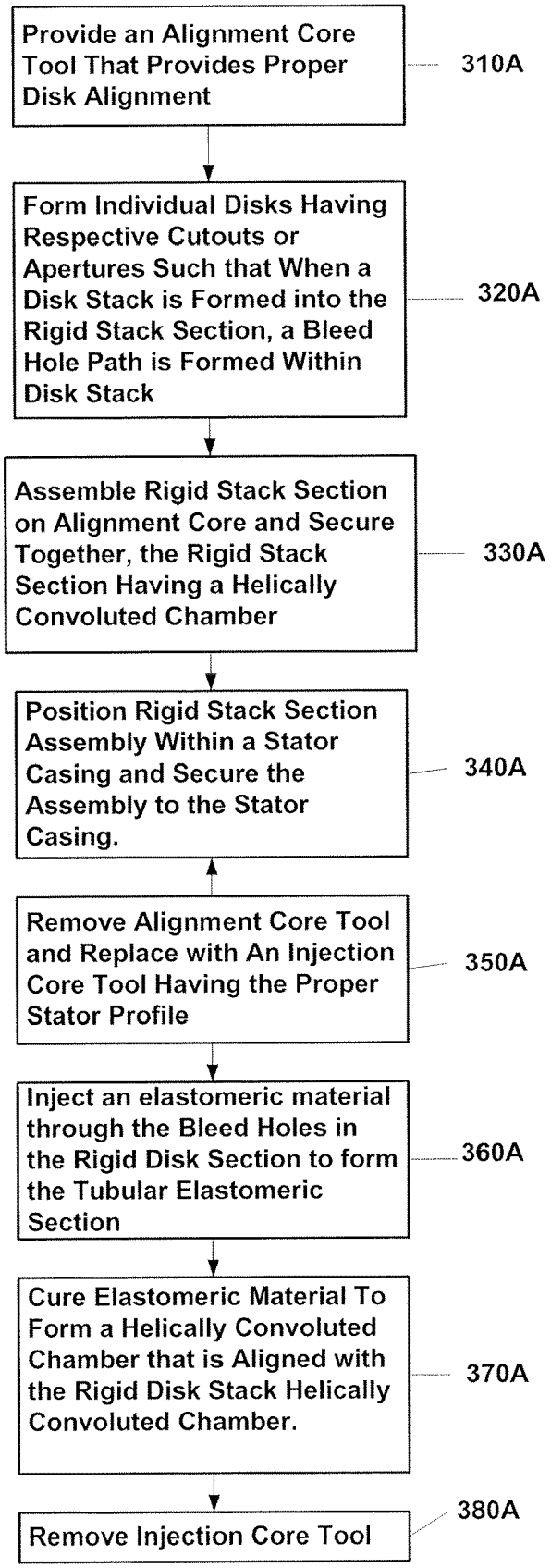
FIG. 17A is a flow diagram illustrating an alternative method for forming the tubular elastomer of the broadest configuration of the first embodiment when a rigid disk section having bleed holes is used.

As mentioned earlier, bleed holes BH can be used in the rigid disk stack 30 to provide an alternative method of forming the tubular elastomer 22 or 54. FIG. 17A depicts the process of forming the tubular elastomer 22 of the first embodiment. In particular, at step 310A, the alignment core tool is provided. At step 320A, the individual disks that form the disk stack 30 comprise respective cutouts or apertures such that when the plurality of disks are placed on the alignment core tool, a disk stack 30 is formed into the rigid disk section 30 which also comprises "bleed hole paths" therethrough. At step 330A, the assembled disk stack 30 with the bleed hole paths are secured together to form the rigid disk stack 30 section having a helically convoluted chamber as well as the bleed hole paths. At step 340A, the alignment core tool with the disk stack 30 is positioned inside the stator casing 26 at the proper location and the disk stack 30 is secured to the stator casing 26. At step 350A, the alignment core tool is removed and replaced with an injection core tool having the proper stator profile as discussed previously. At step 360A, the elastomeric material is injected through the bleed holes in the rigid disk stack 30 to form the tubular elastomeric section 22. At step 370A, the elastomeric material is cured to form its own helically convoluted chamber that is aligned with the helically convoluted chamber in the disk stack 30. The disk stack 30 and tubular elastomeric section 22 are secured together and at step 370A and at step 380A the injector core tool is removed. The other configurations where the rigid disk section 30 is used (FIGS. 7, 14A, 14C-14D and 14F-14H) can be formed in accordance with the processes described previously.

Figure 17B:
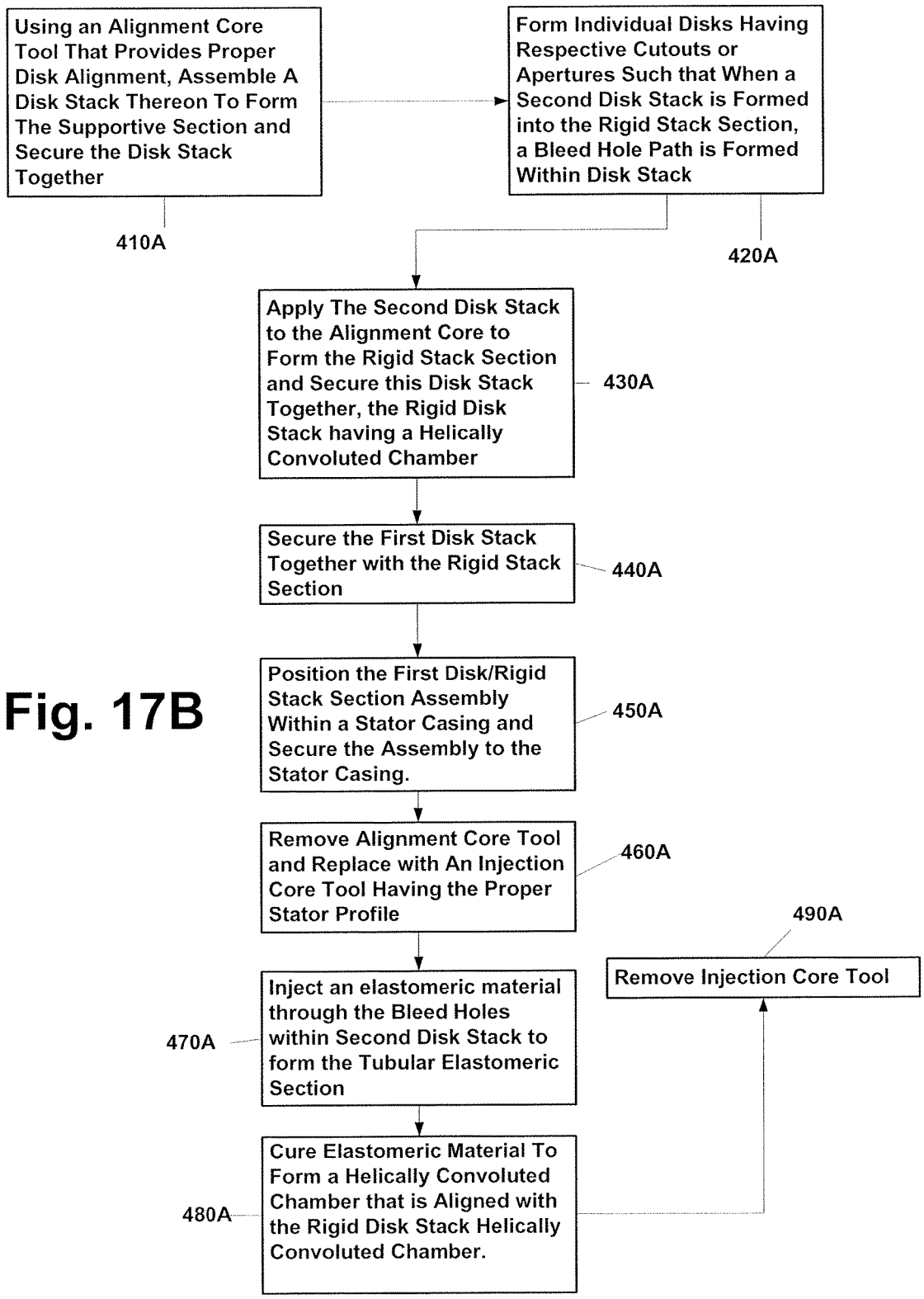
FIG. 17B is a flow diagram illustrating an alternative method for forming the tubular elastomer of the broadest configuration of the second embodiment when a rigid disk section having bleed holes is used.

If the tubular elastomer 54 of the second embodiment is to be formed using bleed holes BH in the rigid disk section 30, then the process in FIG. 17B is followed. In particular, at step 410A, a first disk stack is assembled and secured together at its proper location on the alignment core to form the supportive section 58. At step 420A, the individual disks that form the disk stack 30 (also referred to as the "second disk stack") and which comprise respective cutouts or apertures such that when the plurality of disks are placed on the alignment core tool, a disk stack 30 is formed into the rigid disk section 30 which also comprises "bleed hole paths" therethrough. At step 430A, the second disk stack is secured together on the alignment tool at its proper position. At step 440A, the first disk stack and the second disk stack 30 are secured together. At step 450A, the alignment core tool with the two disk stacks secured together is inserted within the stator casing 26 and they are secured to the stator casing. At step 460A, the alignment core tool is removed and the injection core tool having the proper stator profile is inserted. At step 470A, the elastomeric material is injected through bleed holes BH in the rigid disk stack 30 to form the tubular elastomeric section 54. At step 480A, the elastomeric material is cured to form its own helically convoluted chamber that is aligned with the helically convoluted chamber in the disk stack 30. As mentioned with regard to step 270A, the elastomeric material and the supportive section 58 are bonded, most likely via heat and/or adhesive. The disk stack 30 and tubular elastomeric section 54 are secured together and at step 480A and at step 490A the injector core tool is removed. The other configurations where the rigid disk section 30 is used (FIGS. 11, 15A, 15C-15D and 15F-15H) can be formed in accordance with the processes described previously.

It is also within the broadest scope of the present invention to include alternative means of injecting the rubber into the stator 16/52 that does not require the use of bleed holes BH in the disk stack 30.

In all of the embodiments of the present invention described above, the following should be noted that the way in which the rotor 14 rotates within the stator 26 is known as "nutation" or "nutative communication." In particular, due to the geometry of the rotor 14 and stator 26, the rotor 14 does not rotate about the axis of the pump but rather rotates in one direction about its own axis while orbiting in the opposite direction around an orbital path defined due to the helix geometry.

Figure 7A:
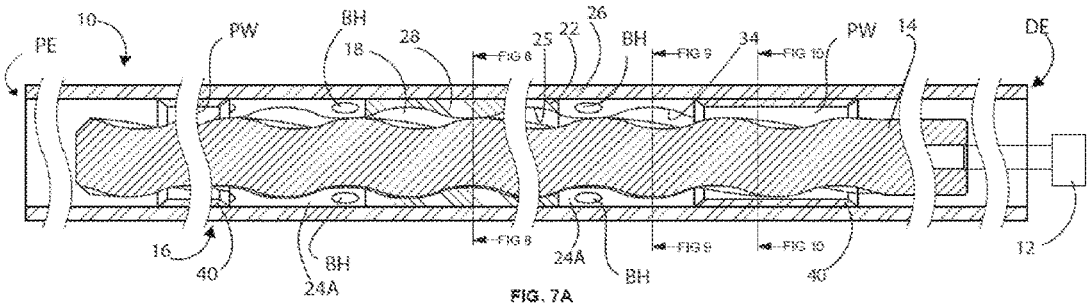
FIG. 7A is a partial, longitudinal cross-sectional view of an exemplary hybrid stator of a first embodiment of the present invention, but using a unitized element for the rigid section.
Figure 11A:
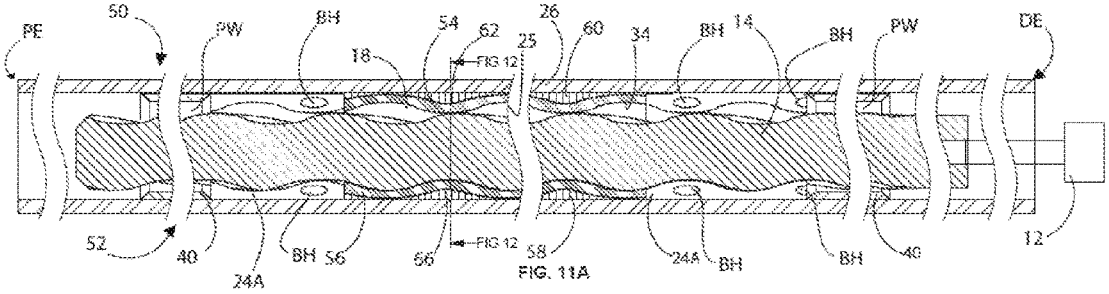
FIG. 11A is a partial, longitudinal cross-sectional view of a second embodiment of an exemplary hybrid stator of the present invention, but using a unitized element for the rigid section.

As mentioned previously, the rigid section 24 in both the first and second embodiments is accomplished by the use of a stack 30 of a plurality of thin disks 32 with an internally shaped inside diameter. However, this is by way of example only. The rigid section 24 may also comprise a unitized element 24A as shown in FIG. 7A in the first embodiment and in FIG. 11A in the second embodiment, rather than the disk stack 30. This unitized element 24A comprises the proper shape formed by the disk stack 30 for positioning in the stator casing 26, including the helically-convoluted chamber, as well as any bleed holes BH paths discussed previously. Thus, the phrase "disk stack" as used in the Specification and Claims also covers any unitized element 24A having the requisite shape and helically-convoluted chamber. It also includes any unitized element 24A having the requisite shape, with the helically-convoluted chamber and with at least one bleed hole BH path. Furthermore, the term "disk stack" covers various materials other than just metal that the unitized element may comprise. Even the supportive section 58 in the second embodiment may be formed as a unitized element (see FIG. 11A).

Exemplary processes for forming the unitized element 24A include:

(a) start with a solid bar and electro-chemically machine (ECM) the internal profile along the length of the bar; the resulting rigid section tube is a single one piece section;

(b) start with a solid bar and internally mill the internal profile along the length of the bar; the resulting rigid section is a single one piece section;

(c) cast the rigid section; the resulting rigid section is a single one piece section.

While the invention has been described in detail and with reference to specific examples thereof, it will be apparent to one skilled in the art that various changes and modifications can be made therein without departing from the spirit and scope thereof. Without further elaboration, the foregoing will so fully illustrate the invention that others may, by applying current or future knowledge; readily adapt the same for use under various conditions of service.

What is claimed is:

1. A stator for a hydraulic motor having an elongated and helically-lobed rotor rotatably disposed therein, said stator comprising:

a cylindrical stator housing;

a first section within said cylindrical stator housing comprising a generally tubular configuration having elastically deformable elastomeric material defining a first helically convoluted chamber section; and a second section adjacent said first helically convoluted chamber section and fixed within said cylindrical stator housing, said second section comprising:

a rigid section comprising a second helically convoluted chamber section matching said first helically convoluted chamber section, wherein the rigid section includes a saw tooth surface that creates a tortuous path for fluid flow between confronting surfaces of the rotor and the saw tooth surface, wherein said first and second helically convoluted chambers are rotationally aligned in a continuous helical relationship to form a helically convoluted chamber for supporting the rotor.

2. The stator of claim 1 wherein said rigid section comprises a unitized element comprising said second helically convoluted chamber section.

3. The stator of claim 1 wherein said rigid section comprises a plurality of rigid disks stacked together comprising said second helically convoluted chamber section.

4. The stator of claim 3 wherein said plurality of rigid disks are concentrically aligned face-to-face in a stacked helical relationship with one another with each of said plurality of rigid disks being rotated with respect to an adjacent one of said plurality of rigid disks progressively along a length of said plurality of rigid disks stacked in one direction of rotation to define said second helically convoluted chamber section.

5. The stator of claim 4 wherein said saw tooth surface is formed from the plurality of rigid disks.

6. The stator of claim 3 wherein said plurality of rigid disks are metal disks.

7. The stator of claim 1 further comprising a rigid sleeve that forms a third section adjacent said rigid section, said rigid sleeve defining a cylindrical chamber section for supporting the rotor and being aligned with said second helically convoluted chamber, said second and third sections forming a sequence of sections on a first side of said first section toward either a distal or proximal end of said cylindrical stator housing.

8. The stator of claim 7 further comprising a second side, opposite said first side of said first section, said second side comprising another rigid sleeve, adjacent said first section.

9. The stator of claim 7 further comprising a second side, opposite said first side of said first section, said second side comprising another rigid section, adjacent said first section.

10. The stator of claim 7 wherein another second section is positioned on a second side, opposite said first side, of said first section with another third section positioned adjacent said another second section toward the other one of said distal or proximal ends of said stator housing.

11. The stator of claim 7 wherein said second sections comprise a unitized element comprising said second helically convoluted chamber section.

12. The stator of claim 7 wherein said second sections comprise said rigid section having a plurality of rigid disks.

13. The stator of claim 12 wherein said plurality of rigid disks are concentrically aligned face-to-face in a stacked helical relationship with one another with each of said plurality of rigid disks being rotated with respect to an adjacent one of said plurality of rigid disks progressively along a length of said plurality of disks stacked in one direction of rotation to define said second helically convoluted chamber section.

14. The stator of claim 13 wherein said plurality of rigid disks forms a surface that comprises the saw tooth surface that, during nutative communication with the rotor, provides a labyrinth seal therebetween.

15. The stator of claim 14 wherein said plurality of rigid disks are metal disks.

16. The stator of claim 1 wherein said second section is located on a first side of said first section and wherein another second section is located on a second side, opposite said first side, of said first section.

17. The stator of claim 16 wherein another third section is located on said second side.

18. The stator of claim 1 further comprising a rigid sleeve defining a cylindrical chamber section for supporting the rotor.

19. The stator of claim 1 further comprising a rigid sleeve that forms a third section adjacent said first section, said rigid sleeve defining a cylindrical chamber section for supporting the rotor.

20. The stator of claim 1 wherein said generally tubular configuration having the elastically deformable elastomeric material comprises an elastically deformable liner that faces the elongated and helically-lobed rotor.

21. The stator of claim 20 wherein said generally tubular configuration having the elastically deformable elastomeric material comprises a supportive portion that is bonded to said cylindrical stator housing.

22. The stator of claim 21 wherein said supportive portion comprises another plurality of disks stacked together and having lobed shaped surfaces against which said elastically deformable liner is positioned.

* * * * *